US007181774B2

(12) United States Patent
Silver

(10) Patent No.: US 7,181,774 B2
(45) Date of Patent: Feb. 27, 2007

(54) VENTILATED SAFETY OUTERWEAR

(75) Inventor: James Barry Silver, Dundas (CA)

(73) Assignee: Safety-Short Workwair Inc., Dundas (CA)

( * ) Notice: Subject to any disclaimer, the term of this patent is extended or adjusted under 35 U.S.C. 154(b) by 9 days.

(21) Appl. No.: 10/834,941

(22) Filed: Apr. 30, 2004

(65) Prior Publication Data

US 2004/0199980 A1 Oct. 14, 2004

Related U.S. Application Data

(63) Continuation-in-part of application No. 10/231,069, filed on Aug. 30, 2002, now Pat. No. 6,968,573.

(30) Foreign Application Priority Data

Apr. 30, 2003 (CA) ..... 2427256

(51) Int. Cl.
*A41D 1/06* (2006.01)

(52) U.S. Cl. ..... 2/227; 2/DIG. 1; 2/79

(58) Field of Classification Search ..... 2/227, 2/228, 231, 233, 213, 124, 126, 71, 72, 242, 2/267, 22–24, 69, 456, 215, 400, 406, 238, 2/79

See application file for complete search history.

(56) References Cited

U.S. PATENT DOCUMENTS 308,221 A * 11/1884 Wesihampel ..... 2/404
2,072,614 A * 3/1937 Birch ..... 2/227
2,127,355 A * 8/1938 Grundstrom ..... 2/227
3,761,962 A * 10/1973 Myers ..... 2/79
4,215,435 A * 8/1980 Miele ..... 2/227
4,325,148 A * 4/1982 Livernois ..... 2/465
4,395,781 A * 8/1983 Myers ..... 2/4
4,449,254 A * 5/1984 Fogg ..... 2/407
4,625,336 A * 12/1986 Derderian ..... 2/79
4,716,594 A * 1/1988 Shannon ..... 2/4
4,722,099 A * 2/1988 Kratz ..... 2/79
5,054,127 A * 10/1991 Zevchak ..... 2/247
5,105,473 A * 4/1992 Valtakari ..... 2/461
5,153,944 A * 10/1992 Teel ..... 2/243.1
5,173,967 A * 12/1992 Carter ..... 2/242
5,214,797 A * 6/1993 Tisdale ..... 2/455
5,539,927 A * 7/1996 Holubec ..... 2/69
5,732,412 A * 3/1998 Holden ..... 2/23
5,774,892 A * 7/1998 Tisdale et al. ..... 2/69

(Continued)

*Primary Examiner*—Alissa Hoey
(74) *Attorney, Agent, or Firm*—Patrick J. Hofbauer; Kevin E. Holbeche

(57) ABSTRACT

An article of safety outerwear has a body including: a trunks outerwear part, adapted to receive the lower region of the torso of a wearer in use and having apertures through which the legs of the wearer protrude; and a pair of tubular leg parts, each adapted to receive therethrough a leg of the wearer and extending between an upper end, connected to the trunks outerwear part, and a lower end disposed adjacent to the ankle of said leg. Each leg part includes a tubular vent portion, extending from about the knee to about the ankle of the leg received in the leg part in use. The vent portion is constructed substantially from mesh. The mesh has an open texture for high breathability, presents a smooth surface to the legs in use, and is adapted to provide the wearer with protection against abrasion in normal working and athletic activities.

20 Claims, 6 Drawing Sheets

U.S. PATENT DOCUMENTS 5,864,888 A * 2/1999 Archer ..... 2/227
5,926,851 A * 7/1999 Kovalik ..... 2/227
6,041,447 A * 3/2000 Endler ..... 2/455
6,158,056 A * 12/2000 Riley ..... 2/269
6,189,155 B1 * 2/2001 Boulanger ..... 2/409
6,243,879 B1 * 6/2001 Lyden ..... 2/227
6,347,403 B1 * 2/2002 Wilcox ..... 2/23
6,408,446 B1 * 6/2002 Carrington ..... 2/465
6,421,839 B1 * 7/2002 Vo et al. ..... 2/227
6,460,185 B1 * 10/2002 Hardy ..... 2/69
6,499,141 B1 * 12/2002 Egnew ..... 2/69
6,574,948 B2 * 6/2003 Longtin ..... 54/79.2
2002/0098312 A1 * 7/2002 Sloot ..... 428/45
2004/0163155 A1 * 8/2004 Haughey ..... 2/69
2005/0060792 A1 * 3/2005 Desai ..... 2/403

* cited by examiner

VENTILATED SAFETY OUTERWEAR

FIELD OF THE INVENTION

The present invention relates to the field of safety outerwear (i.e., to a protective outer layer of clothing that may or may not be put on over top of other clothing), and more particularly, to safety outerwear (e.g., pants, coveralls, overalls) for use in industrial settings and in athletics pursuits, such as rollerblading.

BACKGROUND OF THE INVENTION

In hot environments, persons often wish to wear outerwear shorts, also known as outerwear knee breeches, for comfort. However, outerwear knee breeches do not constitute suitable apparel in circumstances wherein, inter alia, the knees of persons wearing such apparel are apt to come into contact with rough surfaces. Indeed, in many settings wherein workers are apt to come into contact with, inter alia, rough surfaces, applicable legislation prohibits the use of outerwear knee breeches. Moreover, in some environments, temperatures can plummet significantly in a relatively short period, in which case, persons wearing outerwear shorts may become uncomfortably cool.

The prior art is replete with examples of outerwear long pants including legs which can be removed from the knee down, thereby to convert into outerwear knee breeches, or the reverse. U.S. Pat. No. 269,479 (Stretch et al.), issued Dec. 19, 1882, is exemplary in this regard.

Such clothing articles are beneficial in that, in hot environments, the clothing can normally be worn with the leg portions removed, and in circumstances wherein the wearer anticipates that his or her knees or lower legs may come into contact with rough surfaces, the leg portions may be reinstated, for safety. However, in circumstances wherein the wearer cannot anticipate when his or her lower legs may be exposed to injury, convertible trousers represent no particular advantage, since, for safety, the wearer must wear the clothing with the leg portions in place at all times, with consequent discomfort.

It is an object of the present invention to provide an article of safety outerwear (hereinafter, alternately referred to simply as safety clothing) which is relatively comfortable to wear in warm conditions, while at the same time, maintaining protective qualities comparable to those inherent in trousers. It is inherent in the foregoing that it is an object of the present invention to provide an article of safety outerwear that is both highly breathable and provides a high measure of protection against abrasion. To this effect, and according to present invention, it is necessary that the article of safety outerwear be breathable and constructed of relatively durable fibers having a high cut and tear resistance.

SUMMARY OF THE INVENTION

In accordance with the present invention there is disclosed an article of safety outerwear.

As one aspect of the invention, the article of safety outerwear comprises a main body piece. The main body piece includes a trunks outerwear part, adapted to receive in encompassing relation the lower region of the torso of a wearer in use and having apertures through which the legs of said wearer protrude in use, and a pair of tubular leg parts, each adapted to receive therethrough a respective protruding leg of said wearer in use and extending between a respective upper end, connected to said trunks outerwear part, and a respective lower end disposed adjacent to the ankle of said respective protruding leg.

The trunks outerwear part is substantially opaque, to conceal the pelvic region of said wearer in use, and each leg part includes a tubular vent portion extending, with respect to the respective protruding leg received in said each leg part in use, from about mid leg to about the ankle. The vent portion is constructed substantially from mesh, said mesh having a substantially open texture for high breathability, presenting a substantially smooth surface to said legs in use and being adapted to provide the wearer protection against abrasion in normal activity selected from the group consisting of working activity and athletic activity. It is inherent in the foregoing that, according to one aspect of the invention, the mesh is adapted to provide a high measure of protection against abrasion. To this effect, and according to the invention, it is necessary that the article of safety outerwear be constructed of relatively durable fibers having a high cut and tear resistance that is sufficient to meet current ANSl (i.e., American National Standards Institute) workplace safety standards. It is also inherent in the135 foregoing that, according to these standards, appropriate abrasion protection is not provided by meshes formed purely from natural or cellulose fabrics (i.e., formed solely from fibers drawn from the silkworm cocoon, grown in the fields, and/or spun from the fleece of animals), such as, for example, cotton, linen, nor indeed from any fabrics that were capable of being produced prior to 1939. That is, and in order to provide sufficient protection against abrasion, the athletic jersey mesh is formed at least in part from one of the petrochemically-based manufactured fibers that were first commercially produced after 1938 (e.g., nylon), and preferably, from a petrochemically-based manufactured fiber that was first capable of commercial production after 1952, such as for example polyester.

According to other aspects of the invention, the mesh is preferably athletic jersey mesh, and adapted for high visibility. It is inherent in the foregoing that, according to one aspect of the invention, the athletic jersey mesh is adapted to sufficiently retain high visibility dyes to meet current ANSI safety and chromaticity standards. It is also inherent in the foregoing that, according to these standards, high visibility dyes are not sufficiently retained in purely natural or cellulose fabrics, nor indeed by any fabrics that were capable of being produced prior to 1939. That is, and in order to provide sufficiently high visibility, the athletic jersey mesh is formed at least in part from one of the petrochemically-based manufactured fibers that were first commercially produced after 1938 (e.g., nylon), and preferably, from a petrochemically-based manufactured fiber that was first capable of commercial production after 1952, such as for example polyester.

According to another aspect of the invention, the main body piece may take the form of trouser outerwear.

According to another aspect of the invention, a bib part may alternatively be provided and securely attached to the trunks outerwear part, with the bib part and the main body piece together forming a bib overall.

According to another aspect of the invention, a zippered front jacket part may alternatively be provided and securely attached to the trunks outerwear part, with the jacket part and the main body piece together forming a coverall.

According to another aspect of the invention, a pair of tubular leg shells is preferably detachably secured to said main body piece for covering said leg parts. According to one aspect of the invention, and as depicted in the accompanying drawings, the main body piece is provided with pockets for storing said leg shells when said leg shells are detached from said main body piece.

According to yet another aspect of the invention, the leg shells are preferably constructed of fabric material of substantially closed texture. According to one aspect of the invention, the leg shells are adapted to sufficiently retain high visibility dyes so as to meet current ANSI safety and chromaticity standards. It is inherent in the foregoing that, according to these standards, high visibility dyes are not sufficiently retained in purely natural or cellulose fabrics, nor indeed by any fabrics that were capable of being produced prior to 1939. That is, and in order to ensure sufficiently high visibility, the leg shells are formed at least in part from one of the petrochemically-based manufactured fibers that were first commercially produced after 1938 (e.g., nylon), and preferably, from a petrochemically-based manufactured fiber that was first capable of commercial production after 1952, such as for example polyester.

According to a yet further aspect of the invention, each tubular vent portion preferably extends, with respect to the respective protruding leg received, in use, in the leg part of which said vent portion forms part, from about the knee to about the ankle.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinafter.

BRIEF DESCRIPTION OF THE DRAWINGS

In the accompanying drawings, which should be expressly understood to be for the purpose of illustration and description only, and are not intended as a definition of the limits of the invention.

DETAILED DESCRIPTION OF A PREFERRED EMBODIMENT

Figure 1:
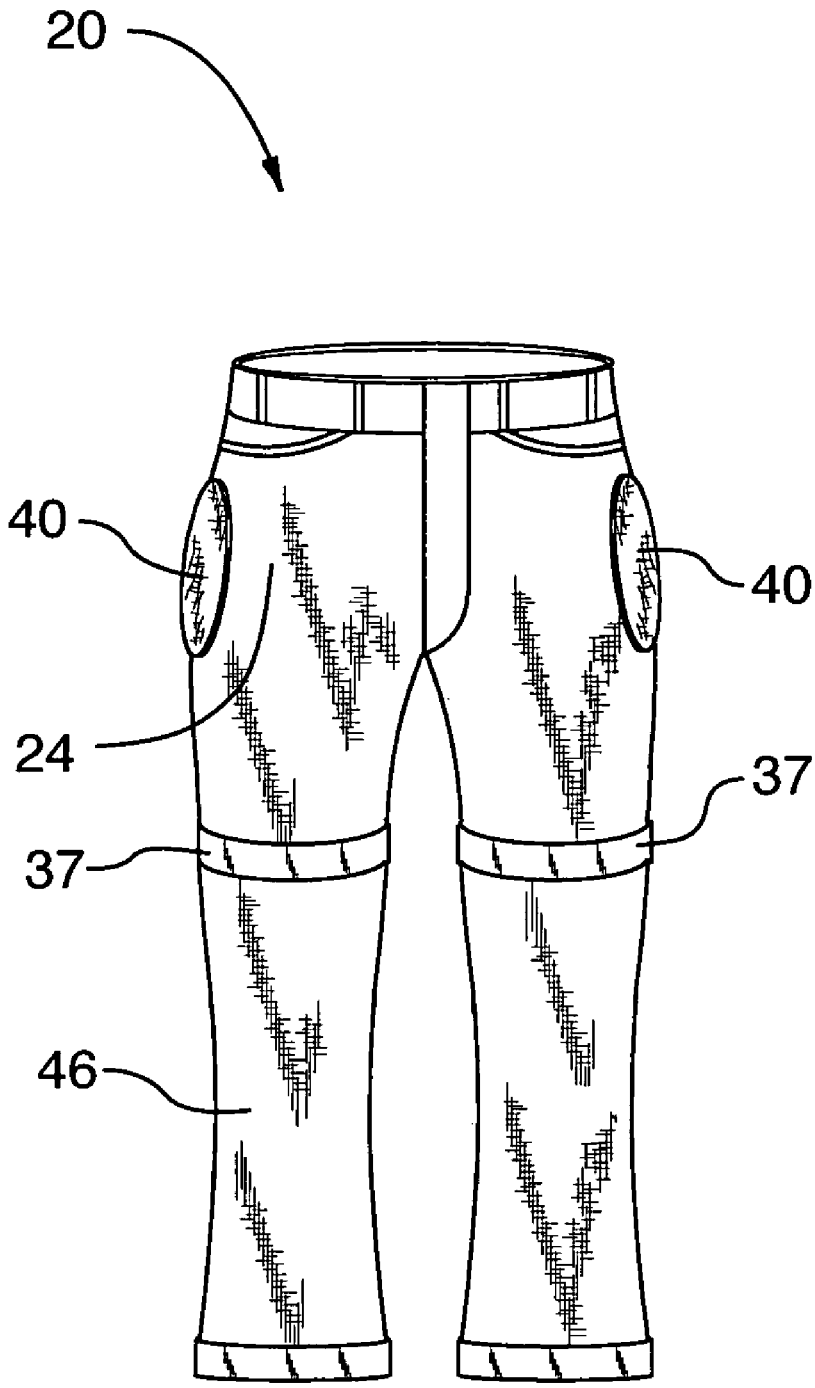
FIG. 1 is a front elevational view of an article of safety outerwear according to a preferred embodiment of the present invention, showing two pockets thereof.

Referring now to FIG. 1 of the drawings there is shown an article of safety clothing according to a preferred embodiment of the present invention and designated with general reference numeral 20.

Figure 3:
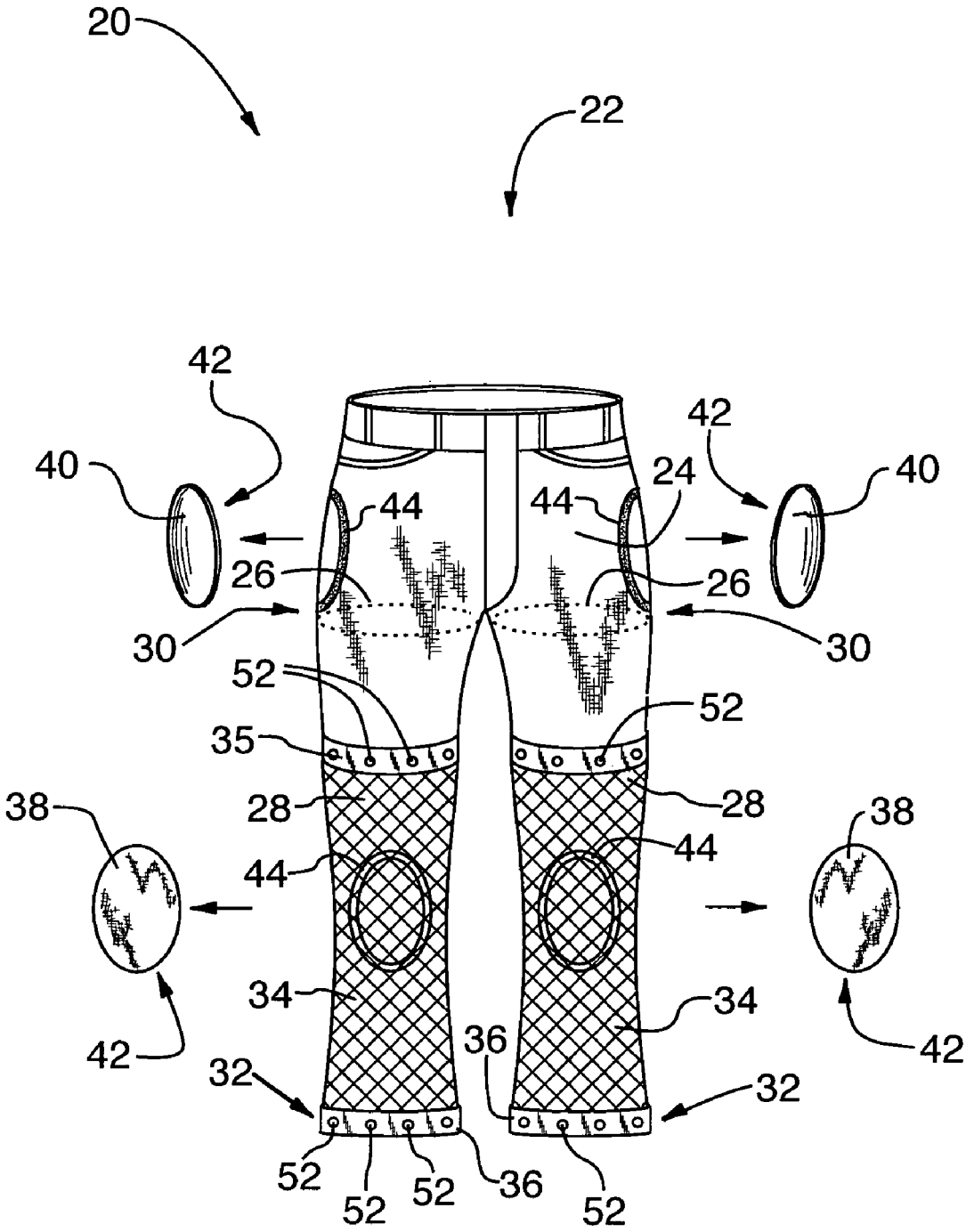
FIG. 3 is an exploded view of the unexploded portion of the article shown in FIG. 2.

As best indicated in FIG. 3, the article 20 comprises a main body piece 22. The main body piece 22, which in the preferred embodiment illustrated takes the form of trouser outerwear (hereinafter, alternately referred to as a pair of trousers), includes a trunks outerwear part 24 (hereinafter, alternately referred to as a trunks part) and a pair of tubular leg parts 28 (hereinafter, alternately referred to as pant leg parts). The trunks part 24 is adapted to receive in encompassing relation the lower region of the torso of a wearer in use and has apertures, defined in dotted outline in FIG. 3 and designated with general reference numerals 26, through which the legs of said wearer protrude in use. The tubular pant leg parts 28 are each adapted to receive therethrough a respective protruding leg of said wearer in use and extend between a respective upper end 30 connected to said trunks part 24 and a respective lower end 32 disposed adjacent the ankle of said respective protruding leg in use.

The trunks part 24 of the preferred embodiment illustrated is substantially opaque, so as to conceal the pelvic region of said wearer in use, and is constructed of relatively sturdy, breathable and washable material, such aS cotton polyester woven textile of substantially closed texture. It is inherent in the foregoing that the trunks part 24 is suitably durable for wear both in athletic pursuits and in the workplace, and that the trunks part 24 is also sufficiently durable to be capable of withstanding an industrial wash program. To this effect, it is necessary for the trunks part 24 to be constructed of durable fibers having a cut and tear resistance that is sufficient for workplace and/or hazardous environments. It is also inherent in the foregoing that purely natural or cellulose fabrics are not sufficiently durable for use in the trunks part 24, nor indeed are any number of other fabrics that were capable of being produced prior to 1939 (including, among others, both cotton and linen). That is, and in order to provide sufficient durability according to one aspect of the invention, the trunks part 24 is formed at least in part from one of the petrochemically-based manufactured fibers that were first commercially produced after 1938 (e.g., nylon), and preferably, from a petrochemically-based manufactured fiber that was first capable of commercial production after 1952, such as for example polyester.

Each pant leg part 28 of the preferred embodiment includes a tubular vent portion 34 extending, with respect to the respective leg disposed within said each leg part 28 in use, from about mid leg to about the ankle.

The vent portion 34 is constructed substantially from mesh, said mesh having a substantially open texture for high breathability, presenting a substantially smooth surface to said legs in use and being adapted to provide the wearer protection against abrasion in normal activity selected from the group consisting of working activity and athletic activity. The mesh is a polyester athletic jersey mesh adapted for high visibility, for safety. It is inherent In the foregoing that, according to one aspect of the invention, the athletic jersey mesh is formed from a petrochemically-based manufactured fiber that was first capable of commercial production after 1952. One mesh suitable for many applications is AM20 ATHLETIC JERSEY MESH sold by Davey Fabrics Inc., of Edmonton, Alberta, Canada.

In the preferred embodiment illustrated, a reinforced cuff 36 is sewn onto the mesh at the lower end 32 of the leg part 28. The provision of such reinforced cuff 36 avoids undue wear, which might otherwise occur if the mesh extended fully through to the lower end 32.

Figure 2:
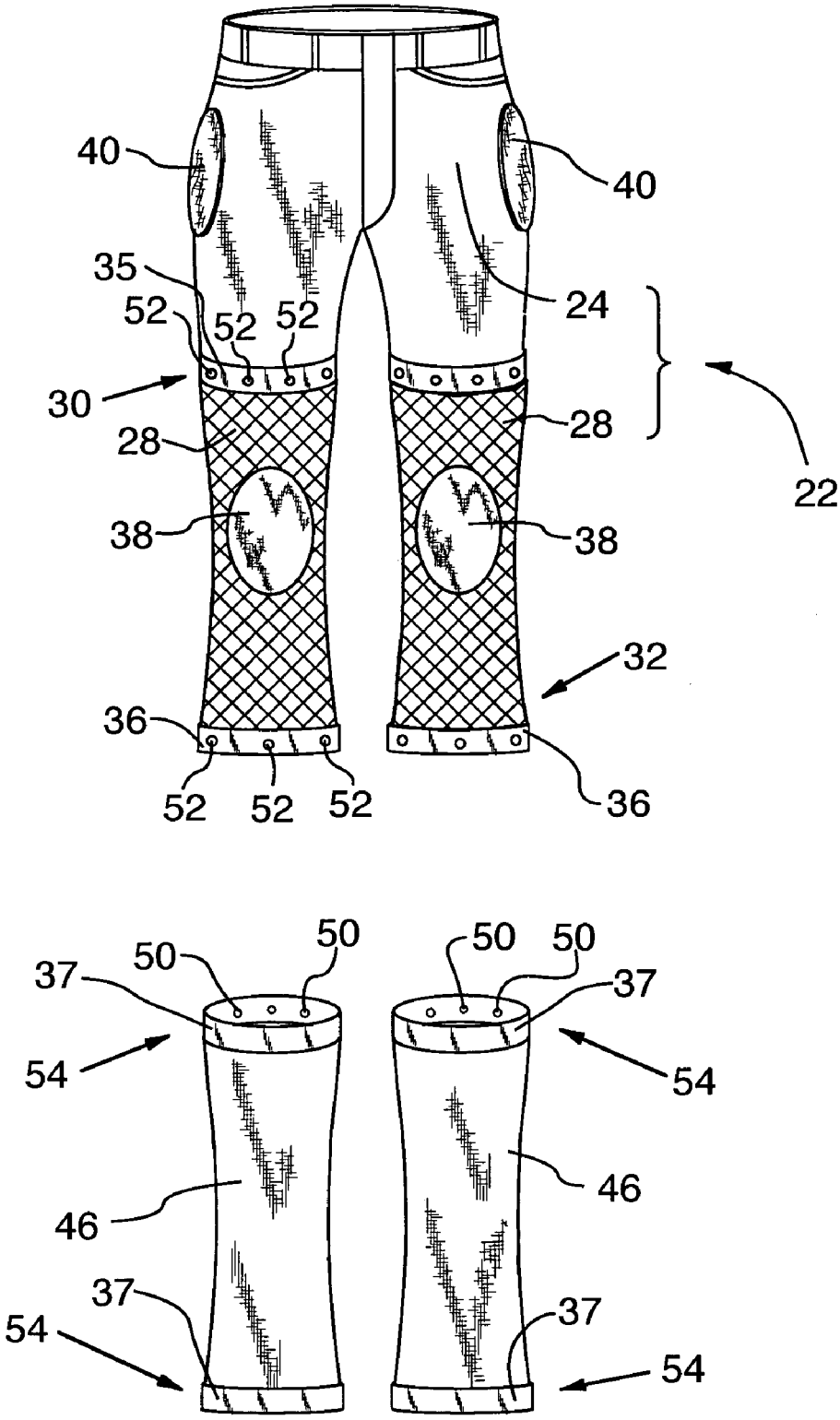
FIG. 2 is a partially exploded view of the article of safety outerwear of FIG. 1.

As other features of the preferred embodiment and best seen in FIG. 2, a pair of first pads 38 are removably attached to said main body piece 22 to cover respective knees of said wearer in use, and a pair of second pads 40 are removably attached to said main body piece 22 to cover respective hips of said wearer in use. As best indicated in FIG. 3, such removable attachment is effected, in the preferred embodiment, by hook 42 and loop 44 fasteners, of the type sold by Velcro Inc. under the trade mark VELCRO, secured to the pads 38,40 and the main body piece 22, respectively. The first pads 38 and the second pads 40 are shown attached to the main body piece 22 in FIG. 2, and detached therefrom in FIG. 3.

As a further feature illustrated in FIG. 1, a pair of tubular leg shells 46 are preferably provided, and detachably secured to said main body piece 22 for covering said pant leg parts 28 and, when attached, said first pads 38. Shells 46 are constructed of relatively durable, weatherproof, washable and fire resistant material of substantially closed texture, so as to maximize protection from, inter alia, the elements and workplace hazards, when attached. It is inherent in the foregoing that the shells 46 are suitably durable for wear in the workplace, and that the shells 46 are also sufficiently durable to be capable of withstanding the industrial wash program. To this effect, it is necessary for the shells 46 to be constructed of durable fibers, having a cut and tear resistance sufficient for workplace and/or hazardous environments. It is also inherent in the foregoing that purely natural or cellulose fabrics are not sufficiently durable, nor sufficiently fire resistant, for use in the shells 46, nor indeed are any number of other fabrics that were capable of being produced prior to 1939 (including, among others, both cotton and linen). That is, and in order to provide sufficient durability according to one aspect of the invention, the shells 46 are formed at least in part from one of the petrochemically-based manufactured fibers that were first commercially produced after 1938 (e.g., nylon), and preferably, from a petrochemically-based manufactured fiber that was first capable of commercial production after 1952, such as for example polyester. More preferably, the shells 46 are formed from a high temperature and flame resistant petrochemically-based manufactured fiber.

Such detachable securement of the shells 46 is effected, in the preferred embodiment illustrated, by a plurality of conventional snaps each comprising a male snap 50 and a female snap 52. The female snaps 52, as illustrated in FIG. 3, are fixedly secured to band portions 35 which extend about the pant leg parts 28 and about the reinforced cuffs 36; male snaps 50, as indicated in FIG. 2, are fixedly secured about the inner periphery of tubular fillet portions 37 which are disposed at opposite ends 54 of the shells 46.

In use, the article of safety clothing 20 can be worn in the manner of conventional trousers. In, for example, cold weather, the shells 46 may be slipped over the leg parts 28, and secured to the trunks part 24 by snaps 50,52; in hot weather, the process may be reversed, and the shells 46 rolled up and conveniently stored, in, for example, a lunch box, thereby to expose the mesh, and provide comfort to the wearer, while at the same time providing protection against abrasion, as well as some measure of protection against burns and sunburn. Depending upon the type of activity in which the wearer is to be engaged, the first pads 38 and the second pads 40 may be secured to the main body piece 22, or removed from the main body piece 22 and stored. It is apparent from FIGS. 1, 4 and 7, among others, that each of the embodiments of the invention is provided with at least two pockets. It is inherent that such pockets will find many different uses both in the workplace and while participating in athletic activities, such as to temporarily store objects while the wearer's hands are otherwise occupied in the working or athletic activity. It is also inherent that such pockets might be used to store the shells 46 when the shells 46 are detached from the main body piece 22.

In the preferred embodiment illustrated, the reinforced cuffs 36, fillet portions 37 and band portions 35 are constructed of a reflective fabric, so as to render the wearer more visible to, inter alia, motorized vehicles.

Figure 4:
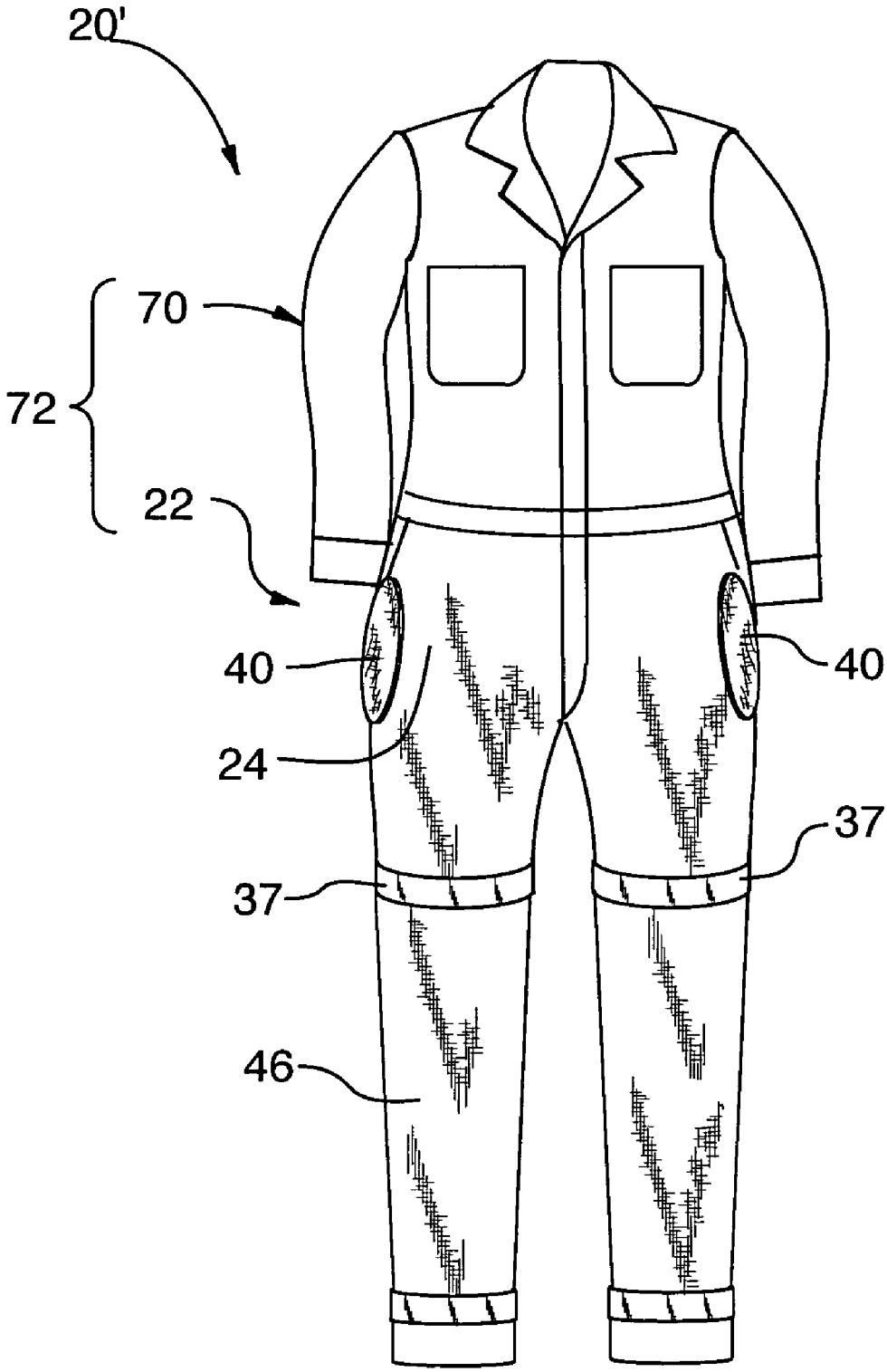
FIG. 4 is a front elevational view of an article of safety outerwear according to a first alternative embodiment of the invention, showing four pockets thereof.
Figures 5, 6:
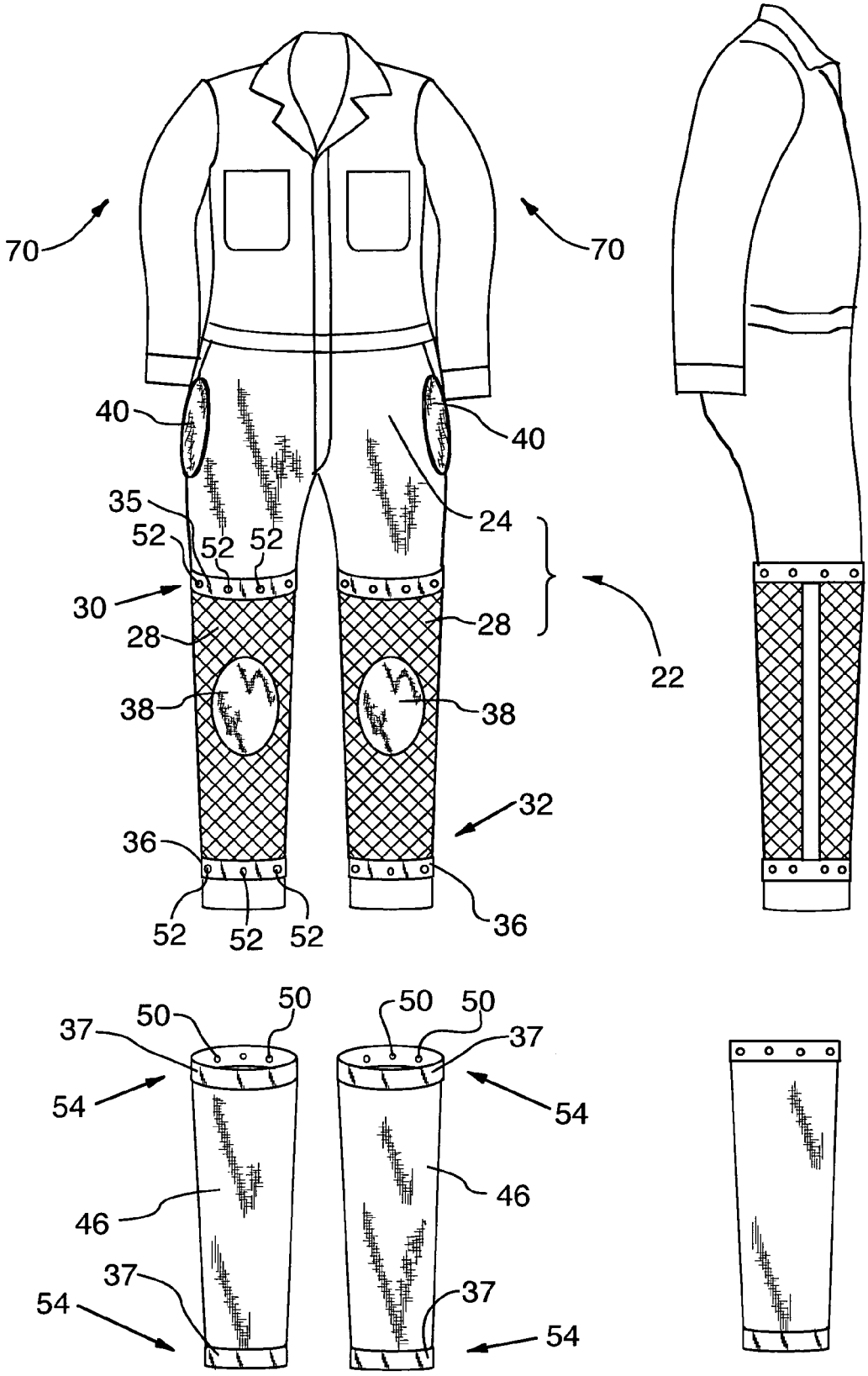
FIG. 5 is a partially exploded view of the article of safety outerwear shown in FIG. 4.
FIG. 6 is a side elevational view of the structure of FIG. 5.

A first alternative embodiment of the invention is illustrated in FIGS. 4, 5 and 6. The article of safety clothing of this embodiment, designated with general reference numeral 20', differs from the preferred embodiment in that a zippered front jacket part 70 is provided and securely attached to the trunks part 24, with the jacket part 70 and the main body piece 22 together forming a coverall 72.

As well, in contrast to the situation of the preferred embodiment wherein the pant leg parts 28 were tailored in the manner of a conventional pair of trousers, the tubular vent portion 34 of each pant leg part 28 in the first alternative embodiment tapers towards the lower end 32, and the leg shells 46 are similarly tapered; this permits the leg shells 46 to be interchangeable, for use on either leg. In all other material respects, the structure of the first alternative embodiment is identical to that of the preferred embodiment, and accordingly, is not described in detail herein.

Figure 7:
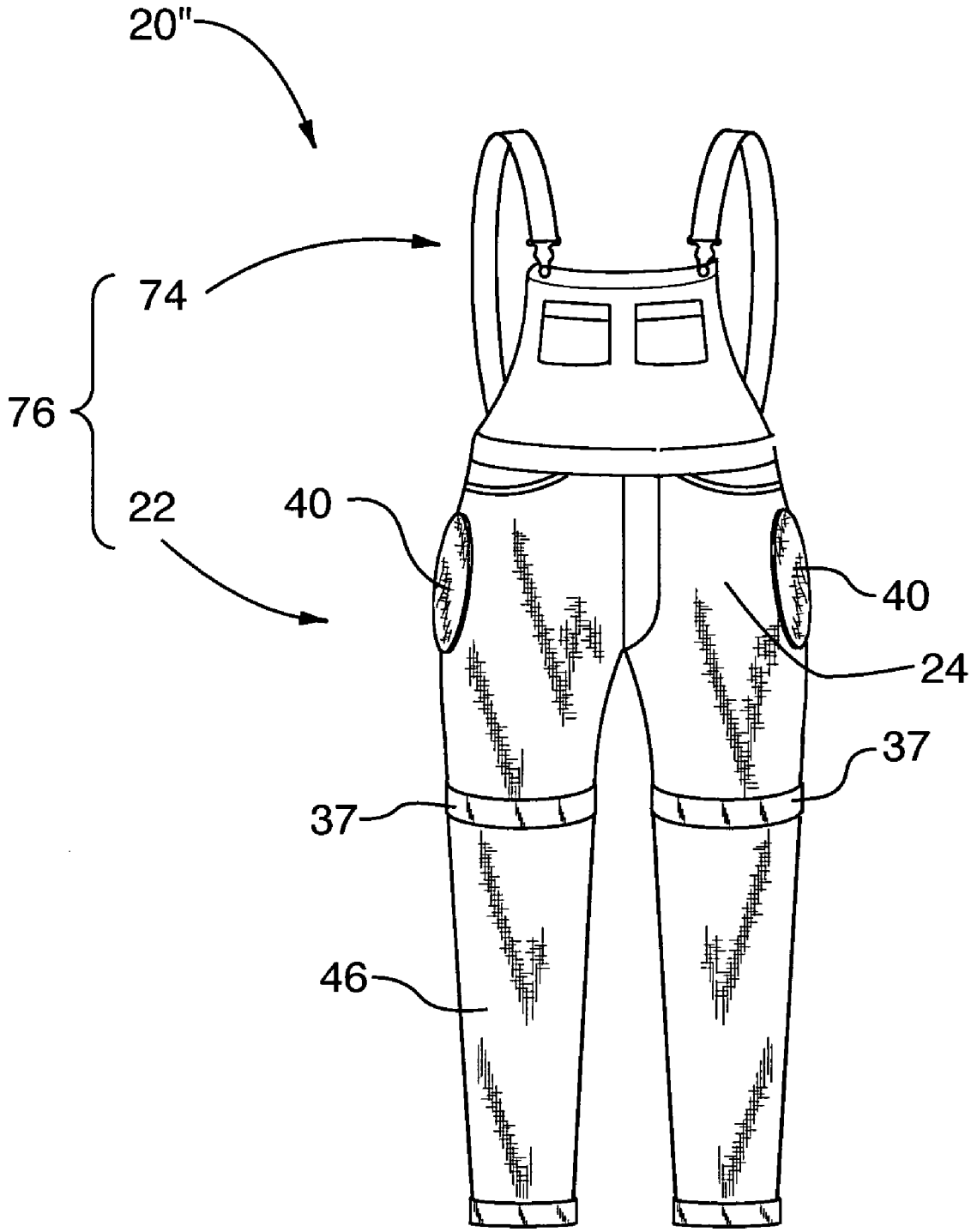
FIG. 7 is a front elevational view of an article of safety outerwear according to a second alternative embodiment of the invention, showing four pockets thereof.

A second alternative embodiment of the invention is illustrated in FIG. 7 and designated with general reference numeral 20". In contrast to the first alternative embodiment, wherein a jacket part 70 was provided, in the second alternative embodiment, a bib part 74 is provided and securely attached to the trunks part 24, with the bib part 74 and the main body piece 22 together forming a bib overall 76. In all other material respects, the structure of the second alternative embodiment is identical to that of the first alternative embodiment, and accordingly, is not described in detail herein Various other modifications may be used in the design and manufacture of the article of safety clothing according to the present invention without departing from the spirit and scope of the invention.

For example, whereas the vent portions of the preferred embodiment extend from about the knee to about the ankle, such that the non mesh portions of the pant leg parts and the trunks part form outerwear knee breeches, it will be evident that the vent portions could be smaller or larger, to suit the style of the wearer.

Further, whereas the first pads and the second pads of the preferred embodiment are removably attached by hook and loop fasteners, it will be evident that other means for such removable attachment, such as, for example, zippers, could be utilized.

Moreover, the first pads and the second pads could be rigidly affixed, by stitching, or omitted altogether.

Yet further, whereas the shells of the preferred embodiment are secured by snaps, it will be evident that securement could be effected through other conventional means, such as zippers, buttons or hook and loop fasteners.

As well, whereas in the preferred embodiment illustrated, the reinforced cuffs, fillet portions and band portions are constructed of a reflective fabric, it should be understood that, alternatively, reflective material could be secured to the main body piece, for example, in a vertical line along each outer seam.

Moreover, while reinforced cuffs are provided in the preferred embodiment, it should be understood that cuffs are not essential. In this regard, it is noted that those skilled in the art have, in the past, previously found that cuffs are essential in order to retain the shape of mesh structures that are formed from pre-1939 materials, fabrics and fibers. It is inherent that the use of post-1938 materials in the mesh of the present invention has removed the need for such cuffs. For example, the ends of the pant leg parts could be provided with drawstring closures, elastic banding or a flap type closure, with hook and loop fasteners, in circumstances wherein it was desired to ensure a snug fit around, for example, the safety boots of a wearer. Stirrups could also be provided, so as to ensure that the pant leg parts did not inadvertently ride up on the legs of the wearer, and expose same to possible injury.

Accordingly, it should be understood that the present invention is limited only by the accompanying claims, purposively construed.

I claim:

1. An article of safety outerwear comprising:

a main body piece including:

a trunks outerwear part, adapted to receive in encompassing relation the lower region of the torso of a wearer in use and having apertures through which the legs of said wearer protrude in use; and a pair of tubular leg parts, each adapted to receive therethrough a respective protruding leg of said wearer in use and extending between a respective upper end, connected to said trunks outerwear part and a respective lower end disposed adjacent to the ankle of said respective protruding leg, wherein the trunks outerwear part is substantially opaque, to conceal the pelvic region of said wearer in use;

each leg part includes a tubular vent portion, extending, with respect to the respective protruding leg received in said each leg part in use, from about mid leg to about the ankle, said vent portion being constructed substantially from mesh, said mesh having a substantially open texture for high breathability, presenting a substantially smooth surface to said legs in use and being adapted to provide the wearer protection against abrasion in normal activity selected from the group consisting of working activity and athletic activity;

wherein the mesh is formed at least in part from a petrochemically-based manufactured fiber so as to provide the wearer with adequate protection against abrasion in the workplace;

said main body piece includes a pocket means for temporarily storing items during a normal activity selected from the group consisting of workplace activities and athletic activities; and such pocket means comprises at least one pocket that is sized to receive and store a pair of tubular leg shells which are detachably securable to said main body piece for covering said leg parts.

2. An article according to claim 1, wherein the mesh retains a high visibility dye.

3. An article according to claim 1, wherein the main body piece is trouser outerwear.

4. An article according to claim 1, further comprising a bib part securely attached to the trunks outerwear part, wherein the bib part and the main body piece together form a bib overall.

5. An article according to claim 1, further comprising a zippered front jacket part securely attached to the trunks outerwear part, wherein the jacket part and the main body piece together form a coverall.

6. An article according to claim 1, further comprising a pair of first pads attached to said main body piece to cover respective knees of said wearer in use.

7. An article according to claim 1, further comprising a pair of first pads removably attached to said main body piece to cover respective knees of said wearer in use.

8. An article according to claim 1, further comprising a pair of second pads attached to said main body piece to cover respective hips of said wearer in use.

9. An article according to claim 1, further comprising a pair of second pads removably attached to said main body piece to cover respective hips of said wearer in use.

10. An article according to claim 1, wherein each tubular vent portion, extends, with respect to the respective protruding leg received, in use, in the leg part of which said vent portion forms part, from about the knee to about the ankle.

11. An article according to claim 1, wherein said petrochemically-based manufactured fiber is polyester.

12. An article according to claim 1, wherein said at least one pocket comprises at least two pockets.

13. An article according to claim 1, wherein said trunks part is formed at least in part from said petrochemically-based manufactured fiber so as to be capable of withstanding an industrial wash program.

14. An article according to claim 1, wherein said petrochemically-based manufactured fiber is a high temperature flame resistant petrochemically-based manufactured fiber.

15. An article according to claim 1, wherein the mesh is athletic jersey mesh.

16. An article of safety outerwear comprising:

a main body piece including:

a trunks outerwear part, adapted to receive in encompassing relation the lower region of the torso of a wearer in use and having apertures through which the legs of said wearer protrude in use; and a pair of tubular leg parts, each adapted to receive therethrough a respective protruding leg of said wearer in use and extending between a respective upper end, connected to said trunks outerwear part and a respective lower end disposed adjacent to the ankle of said respective protruding leg, wherein the trunks outerwear part is substantially opaque, to conceal the pelvic region of said wearer in use; and each leg part includes a tubular vent portion, extending, with respect to the respective protruding leg received in said each leg part in use, from about mid leg to about the ankle, said vent portion being constructed substantially from mesh said mesh having a substantially open texture for high breathability presenting a substantially smooth surface to said legs in use and being adapted to provide the wearer protection against abrasion in normal activity selected from the group consisting of working activity and athletic activity; wherein the mesh is formed at least in part from a petrochemically-based manufactured fiber so as to provide the wearer with adequate protection against abrasion in the workplace; and further comprising a pair of tubular leg shells detachably secured to said main body piece for covering said leg parts, and wherein the main body piece is provided with at least one pocket means for storing the leg shells when the leg shells are detached from the main body piece.

17. An article according to claim 16, wherein the leg shells are constructed of fabric material of substantially closed texture.

18. An article according to claim 16, wherein said leg shells are formed at least in part from said petrochemically-based manufactured fiber so as to be capable of withstanding an industrial wash program.

19. An article according to claim 16, further comprising a bib part securely attached to the trunks outerwear part, wherein the bib part and the main body piece together form a bib overall.

20. An article according to claim 16, further comprising a zippered front jacket part securely attached to the trunks outerwear part, wherein the jacket part and the main body piece together form a coverall.

* * * * *